US010024617B1

(12) United States Patent
Moore et al.

(10) Patent No.: US 10,024,617 B1
(45) Date of Patent: Jul. 17, 2018

(54) FLASH AND SOUND SUPPRESSOR FOR A FIREARM

(71) Applicant: FN AMERICA, LLC, McLean, VA (US)

(72) Inventors: Charles A. Moore, Columbia, SC (US); Thomas A. Mooty, Manchester, NH (US)

(73) Assignee: FN Herstal, SA, Herstal (BE)

( * ) Notice: Subject to any disclaimer, the term of this patent is extended or adjusted under 35 U.S.C. 154(b) by 0 days.

(21) Appl. No.: 15/399,242

(22) Filed: Jan. 5, 2017

Related U.S. Application Data

(60) Provisional application No. 62/275,063, filed on Jan. 5, 2016.

(51) Int. Cl.
*F41A 21/00* (2006.01)
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
USPC ..... 89/14.2
See application file for complete search history.

(56) References Cited

U.S. PATENT DOCUMENTS 3,667,570 A * 6/1972 WerBell, III ..... F41A 21/30 181/223
5,164,535 A * 11/1992 Leasure ..... F41A 21/30 181/223
8,167,084 B1 * 5/2012 Moore ..... F41A 21/30 181/223
8,424,635 B1 4/2013 Klawunn
8,453,789 B1 * 6/2013 Honigmann ..... F41A 21/30 181/223
8,490,535 B1 * 7/2013 Moore ..... F41A 21/30 181/223
8,584,794 B2 * 11/2013 Dueck ..... F41A 21/30 181/223
8,714,301 B2 5/2014 Shults
8,820,473 B1 9/2014 White
8,833,512 B2 9/2014 Smith el al.
8,881,862 B1 11/2014 Messer, Jr. et al.
(Continued)

FOREIGN PATENT DOCUMENTS

WO 1983001680 A1 5/1983

*Primary Examiner* — Samir Abdosh
(74) *Attorney, Agent, or Firm* — Nexsen Pruet, LLC; Todd A. Serbin; Michael A. Mann

(57) ABSTRACT

A flash and sound suppressor for a firearm includes a housing with an inlet nozzle, and an end cap, with plural baffles between them, each having a central hole and a radial gap between the baffle and the housing. Between the flared inlet nozzle and the baffles is a first expansion chamber; between the baffles and the end cap is a second, smaller expansion chamber. The baffles are formed to divide and direct combustion gases between those that follow the bullet through the central hole and those that flow through the radial gap where they are re-directed by the next baffle back across the axis of the housing. The changing orientation of the baffles controls that re-direction. The end cap has an inner, toroidal surface formed to improve mixing in the second expansion chamber, and an outer surface that improves radial gas dispersion and separation.

18 Claims, 3 Drawing Sheets

(56) References Cited

U.S. PATENT DOCUMENTS

| | | | | |
|---|---|---|---|---|
| 8,910,746 | B1 | 12/2014 | McKenzie | |
| 8,939,057 | B1 | 1/2015 | Edsall | |
| 8,950,310 | B2 | 2/2015 | Storrs et al. | |
| 8,967,325 | B1 | 3/2015 | Cronhelm | |
| D728,058 | S | 4/2015 | Cheney | |
| 9,175,920 | B2 * | 11/2015 | Moore | F41A 21/30 |
| 9,593,900 | B2 * | 3/2017 | Vossler | F41A 21/34 |
| 2013/0180150 | A1 * | 7/2013 | Dueck | F41A 21/325<br>42/90 |
| 2013/0180796 | A1 * | 7/2013 | Dueck | F41A 21/30<br>181/223 |
| 2013/0319790 | A1 | 12/2013 | Bladen | |
| 2014/0262604 | A1 | 9/2014 | Proske | |
| 2014/0299405 | A1 | 10/2014 | Miller et al. | |
| 2014/0353076 | A1 | 12/2014 | Bethlenfalvy | |
| 2014/0374189 | A1 | 12/2014 | Young et al. | |
| 2015/0001002 | A1 | 1/2015 | Wirth et al. | |
| 2015/0136519 | A1 * | 5/2015 | Moore | F41A 21/30<br>181/223 |
| 2015/0276340 | A1 * | 10/2015 | Vais | F41A 21/30<br>181/223 |
| 2016/0187093 | A1 * | 6/2016 | Barrett | F41A 21/28<br>89/14.4 |

* cited by examiner

FLASH AND SOUND SUPPRESSOR FOR A FIREARM

TECHNOLOGICAL FIELD

The present disclosure relates to flash suppressors. More specifically, the present disclosure relates to sound and flash suppressors such as those disclosed and described in U.S. Pat. No. 8,490,535.

BACKGROUND

A flash and sound suppressor is intended to conceal the location of a gun when fired. The sound of the firing of a gun and the muzzle flash may pinpoint the location of the gun and provoke a response from an enemy. A suppressor should reduce the sound and limit the flash. It should also not interfere with the trajectory of the bullet.

An improved suppressor is disclosed in commonly-owned U.S. Pat. No. 8,490,535, which is incorporated herein in its entirety by reference.

SUMMARY

According to its major aspects and briefly recited, the present disclosure describes a sound suppressor for a firearm. The suppressor includes a housing having an axis, a proximal end and an opposing distal end. Plural baffles are inside the housing, each of them having a central hole. A portion of each baffle is spaced in part from the interior surface of the housing to define a radial gap.

The proximal end of the housing carries an inlet nozzle that covers the proximal end of the housing. The inlet nozzle includes a flared orifice. The space between the inlet nozzle and the plurality of baffles defines a first expansion chamber.

An end cap is carried by and covers the distal end of the housing. The end cap has a proximal surface and a distal surface and an exit hole formed through the end cap for a bullet to pass. The exit hole is shaped so as to include a plurality of grooves that radiate from the proximal surface of the end cap and increase toward the exit hole at the distal surface. The spacing between the proximal surface of the end cap and the plurality of baffles defines a second expansion chamber. This second expansion chamber is smaller than the first expansion chamber.

A feature of the disclosed suppressor is that the radial gaps of any two sequential baffles are not aligned but are rotated with respect to each other by an azimuthal angle.

Another feature of the disclosed suppressor is that the edge of the baffle at the radial gap is beveled.

Other features of the disclosed suppressor are that the baffle has a proximal face and a distal face, and that the proximal face is perpendicular to the axis of the housing but the distal face is not perpendicular to the axis of the housing. Moreover, a portion of the proximal face includes a stepped area resulting in a greater thickness of the baffle at a first portion of the central hole of the baffle and wherein a second portion of the baffle is thinner than the first portion and is thinner at a second portion of the central hole.

The proximal surface of the end cap has a toroidal shape, that is, its inner surface being concave and curved in a toroidal depression around the exit hole of the end cap. The proximal surface of end cap at exit hole is beveled and the distal surface of end cap at each radial groove forms a hemispherical depression.

Those familiar with the art of suppressors and other components for firearms will take note of these and other features and their advantages of the present disclosure in a careful reading the following detailed description accompanied by the drawings.

DETAILED DESCRIPTION OF THE DISCLOSURE

Referring now to the figures, there is shown a sound suppressor 10 for a firearm. Sound suppressor 10 reduces the decibel level of sound when the firearm fires a round of ammunition from the level it would be without suppressor 10 and may reduce the visibility of the flash that would otherwise occur at the muzzle end of a firearm 12 compared to that without suppressor 10.

Figure 1:
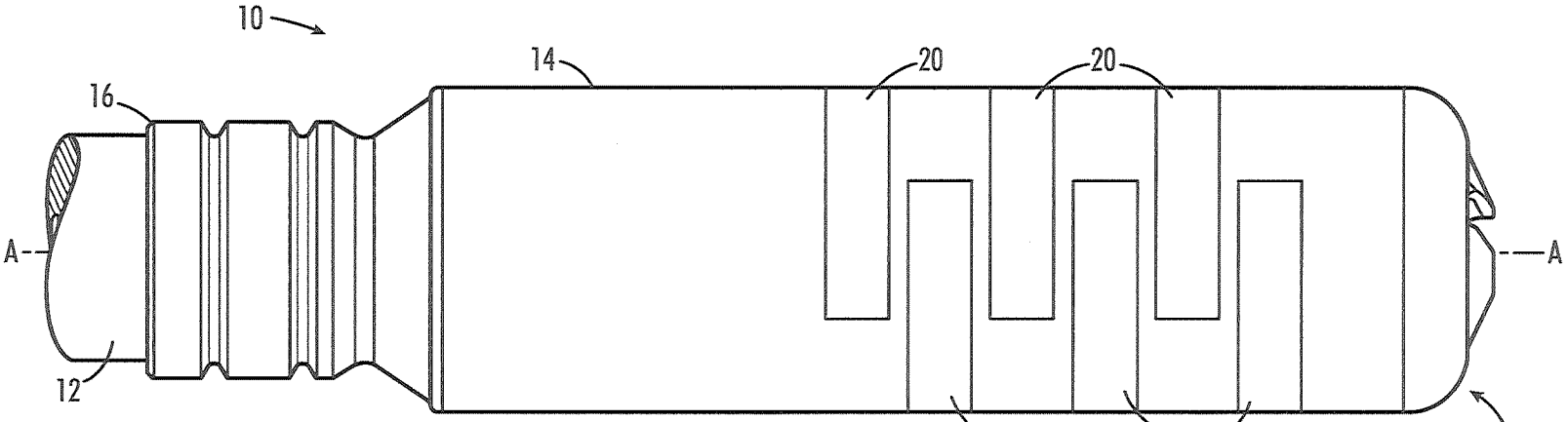
FIG. 1 is a side, exterior, view of the suppressor, according to aspects of the disclosure.

Suppressor 10 includes a housing 14, which has a major axis A parallel to and coaxial with its long dimension, and which housing 14 may be tubular in shape. Housing 14 may be made of a metal or a ceramic material. Suppressor 10 has proximal end 16 and an opposing, distal end 18, with the term proximal end 16 used herein to mean relatively nearer to firearm 12 (FIG. 1) to which suppressor 10 may be attached, and distal end 18 is used to mean relatively farther from firearm 12. Proximal end 16 is toward the left end of suppressor 10 as shown in FIG. 1; distal end 18 is toward the right end of suppressor 10 in FIG. 1. A bullet (not shown) would travel when fired from left to right through suppressor 10.

Figure 2:
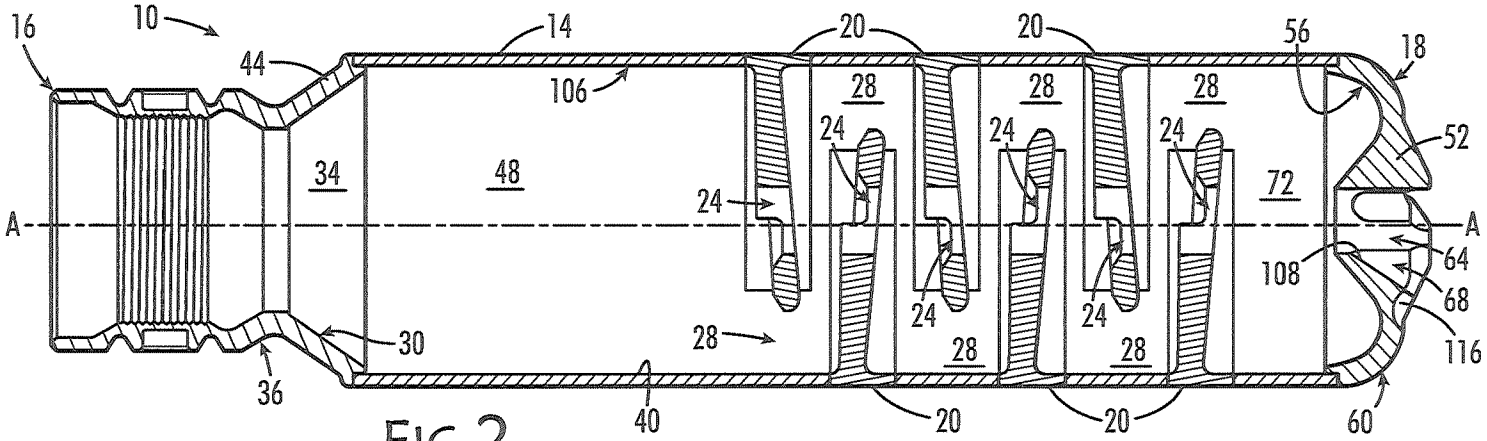
FIG. 2 is a side, cross-sectional view of the suppressor of FIG. 1.
Figure 3:
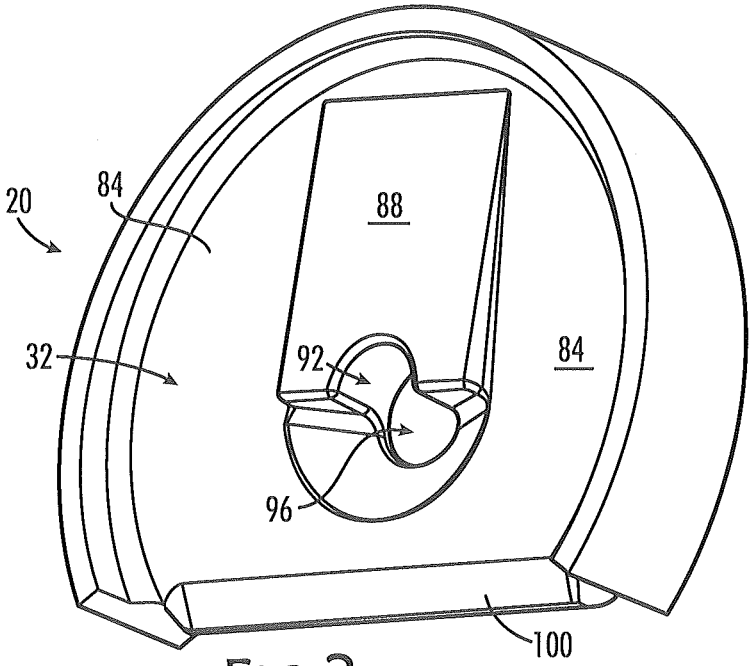
FIG. 3 is a perspective view of a baffle according to an aspect of the present disclosure.
Figure 5:
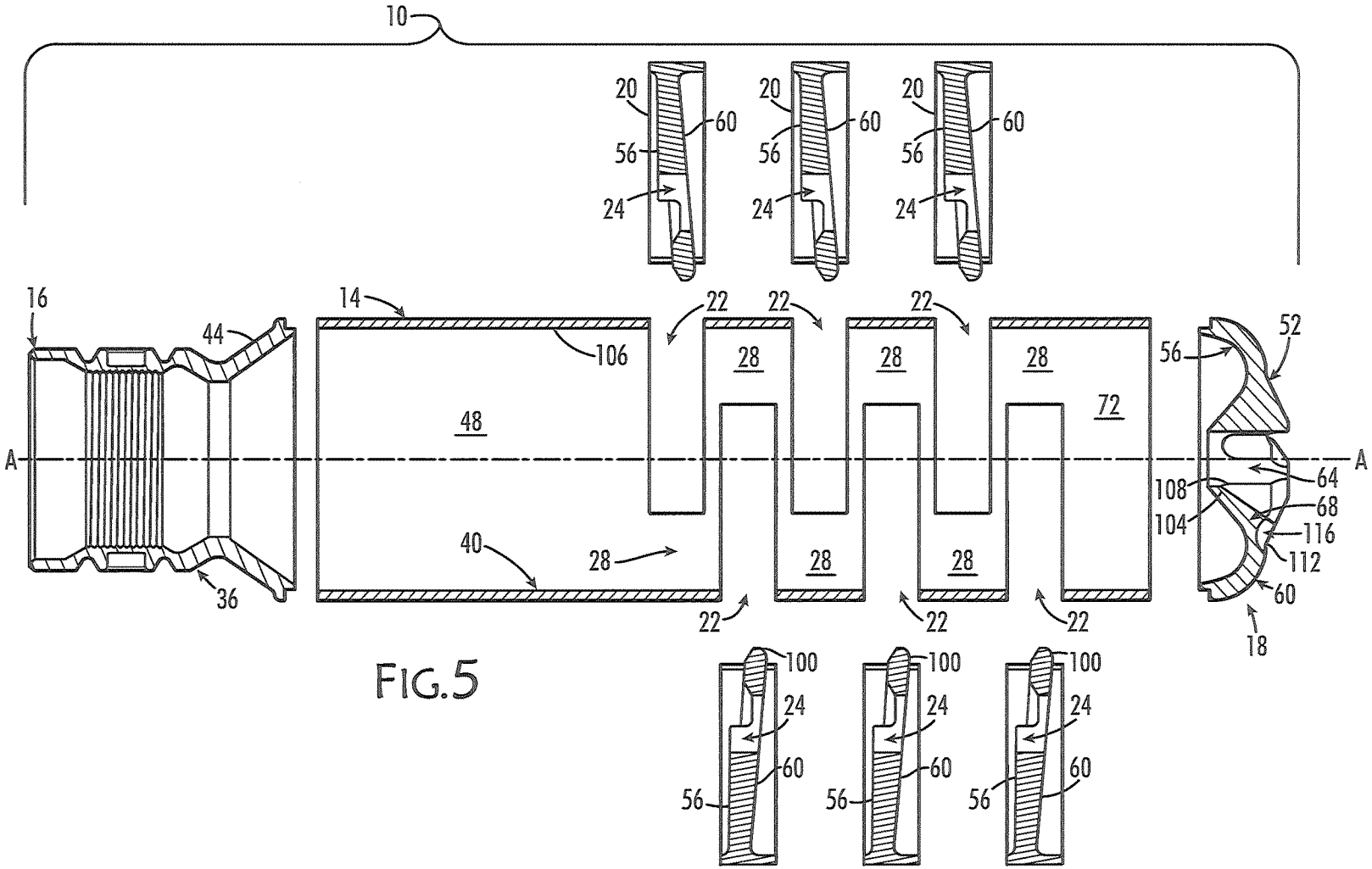
FIG. 5 is a side, cross-sectional, exploded view of the present suppressor, according to an aspect of the present disclosure.

As best seen in FIGS. 2, 3, and 5, housing 14 carries plural baffles 20 inserted into slots 22 (best seen in FIG. 5) formed in housing 14. When baffles 20 are fastened to housing 14, they act has heat exchangers with housing 14 to remove heat. Each baffle 20 of the plural baffles 20 has a central hole 24 and a radial gap 28 as best seen in FIGS. 2 and 3. Six baffles 20 are shown FIGS. 1, 2 and 5. FIGS. 2 and 5 show baffles 20 in cross-section; FIG. 3 shows the proximal face 32 of baffle 20; and FIG. 5 shows an exploded, cross-sectional view of suppressor 10 from the side, and with central hole 24 of each baffle 20 aligned with each other and with the major axis A of housing 14. Radial gap 28 is a gap 28 between the interior surface 40 of housing 14 and a portion of baffle 20 so baffle 20 is radially displaced from major axis A of housing 14 at that portion of baffle 20 to define that gap 28.

At proximal end 16 of housing 14, there is an inlet nozzle 36 covering the proximal end 16 of housing 14. Inlet nozzle 30 has a flared orifice 44. Inlet nozzle 36 and the plurality of baffles 20 define a first expansion chamber 48 between them.

Figure 4:
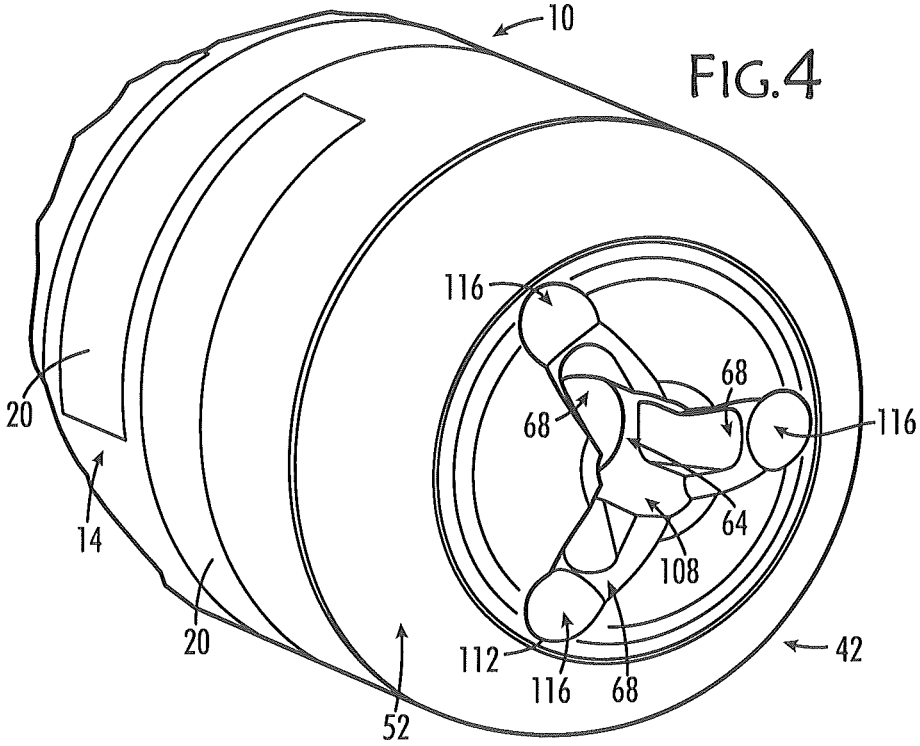
FIG. 4 is a perspective view of the distal end of the suppressor, according to an aspect of the present disclosure.

An end cap 52 covers the distal end 18 of housing 14, as seen in FIGS. 2, 4 and 5. FIG. 2 shows end cap 52 in cross section; FIG. 4 shows end cap 52 in a distal end perspective view; and FIG. 5 shows an exploded, cross-sectional view of suppressor 10 with end cap 52. End cap 52 has a proximal surface 56 and a distal surface 60, and an exit hole 64 running from proximal surface 56 to distal surface 60. Exit hole 64 is dimensioned at proximal surface 56 of end cap 52 to pass a bullet. A plurality of grooves 68 radiate at an angle with respect to axis A from exit hole 64 beginning at proximal surface 54. Exit hole 64 of end cap 52 is aligned with central holes 24 of baffles 20 and inlet nozzle 36 so that a bullet fired from firearm 12 may pass into and through central holes 24 of baffles 20 as is passes along axis A through suppressor 10 and then out through exit hole 64 and on to its target.

The plurality of baffles 20 and inner surface 56 of end cap 52 define a second expansion chamber 72 between them. Second expansion chamber 72 is shorter than first expansion chamber 48, which means that the length of second expansion chamber 72 along axis A is less than the length of first expansion chamber 48 along axis A. Therefore, the volume of second expansion chamber 72 is less than that of first expansion chamber 48.

A feature of the disclosed suppressor 10 is that any two adjacent baffles 20 are rotated by an azimuthal angle with respect to each other so that radial gaps 28 of those adjacent baffles 20 are not aligned. If 14 housing defines a cylindrical coordinate system with the z-direction coincident with the major axis A and the radial direction is radial with respect to axis A, and with the housing at a fixed radius from the axis A, then a third orthogonal dimension is given by the azimuthal angle with respect an arbitration initial radius extending perpendicular to axis A. The rotation of baffle 20 about axis A with respect to an adjacent baffle 20 may be 180 degrees, as shown in FIGS. 1, 2, and 5.

Baffle 20 has a proximal face 76 closer to proximal end 16 and a distal face 80 facing away from proximal end 16 and closer to distal end 18 of housing 14 of suppressor 10. Proximal face 76 and distal face 80 are generally perpendicular to axis A of housing 14, however, distal face 80 is at an angle slightly smaller than perpendicular, so that said distal face 80 leans toward said proximal end 16. Accordingly as combustion gases pass through radial gap 28 in between the immediate baffle 20 and the next baffle 20, the volume between the immediate and next baffles 20 increases drawing the gases across axis A in a serpentine path and toward the next radial gap 28. In addition, proximal face 76 has a first portion 84 and a second portion 88 that lie in different planes, namely, first portion 84 may be perpendicular to axis A; second portion 88 is not perpendicular to axis A but is nearly perpendicular to first portion 84, as best seen in FIG. 3 and also seen in profile in FIGS. 3 and 5. First portion 84 includes part of central hole 24 of baffle 20, that is, central hole 24 itself has a first part 92 bordering on first portion 84 and a second part 96 bordering on second portion 88. Both first part 92 and second part 96 combine to define central hole 24. Thus, first part 92 of central hole 24 is defined by the shape of first portion 84 adjacent to it; second part 96 of central hole 24 is defined by the shape of second portion 82 adjacent to it. Second part 88 has an edge 100 that is beveled. First part 84 is stepped. First part 92 and second part 96 may thus comprise two halves of a central hole 24. Second part 96 of central hole 24 is beveled, and the sizes of first part 92 and second parts 96, with second part 96 being included in second portion 88 of proximal face 76, determines the relative portions of combustion gases that proceed through central hole 22 as opposed to proceeding through radial gap 28. Additionally, this arrangement for central hole 24 causes increased turbulence in the combustion gas that passes through central hole to add to the combustion gas flowing around baffles 20 through radial gaps 28 rather than through central holes 24

Radial gap 28 is an opening between a portion of baffle 20 and a portion of housing 14 wherein the portion of baffle 20 is radially displaced from the portion of housing 14 to define a radial gap 24. At that portion, baffle 20 has an edge 100 and there, the interior surface housing 14, thereby leaving a gap between edge 102 of baffle 20 and housing 14 where baffle 20 and housing 14 separate. Edge 100 may also be beveled.

Beveled edge 100 is formed to channel combustion gases from baffles 20. Also, second portion 88 of proximal face 76 of baffle 20 is not perpendicular to axis A but leans slightly toward inlet nozzle 36 away from radial gap 28 beginning at edge 102 in order to urge relatively more combustion gas toward radial gap 28. The relative sizes of first portion 84 and second portion 88 determines the amount of gas that flow through central hole 22 compared to radial gap 28.

Inner surface 46 of end cap 46 has a toroidal shape, that is, inner surface 46 has a concave depression formed therein that is circular about exit hole 64 and is deeper between exit hole 64 and housing 14 and shallower toward exit hole 64 and housing 14. Inner surface 46 is formed in this toroidal shape to turn combustion gases moving from inlet nozzle 30 to end cap 42 back for mixing in second expansion chamber 72 before venting at exit hole 54.

Outer surface 56 of end cap 52 has plural radial grooves 68 formed in it, with three grooves 68 shown in in FIG. 4. A beveled edge 104 terminates the proximal end 108 of each groove 58 at exit hole 64 of end cap 52. A distal end 112 of each groove 68 terminates in a hemispherical depression 116. The configuration of end cap 52 urges the dispersion of combustion gases radially from exit hole 54 of suppressor 10 to reduces flash.

First expansion chamber 48, defined by the space between inlet nozzle 36 and baffles 20 and is larger than second expansion chamber 72, which is defined by the space between baffles 20 and end cap 52. First expansion chamber 38 is larger than second expansion chamber 72 because of the need to accommodate the greater speed and volume of the combustion gases flowing into first expansion chamber 38. Those gases expand into first expansion chamber 48 as they pass from nozzle 36, thereby commencing to cool. Baffles 20 then divide the combustion gases between so that some flow through central holes 24 following the fired bullet and others are directed by baffles 20 through radial gap 28, which is larger than central hole 24. Because each successive baffle 20 is rotated by an azimuthal angle with respect to the previous one, combustion gases repeatedly cross and re-cross the axis of housing 14 mixing with and calving off additional combustion gases that have flowed through central hole 24, gradually transferring the heat they hold to housing 14 directly and through baffles 20 so that suppressor 10 acts as a heat exchanger to cool the combustion gases prior to exit.

End cap 52 uses its inner surface 56 to increase residency time and mixing of combustion gases prior to their exit through exit hole 64. From exit hole 64 hole, combustion gases expand radially through grooves 58 for additional, radial dispersion and separation. Sound is reduced and flash is reduced Those skilled in the art of firearm suppressors will appreciate that many modifications and substitutions may be made in the foregoing embodiments without departing from the spirit and scope of the present disclosure, which is defined by the appended claims.

What is claimed is:

1. A suppressor for use with a firearm, the suppressor comprising:

(a) a housing having an axis, a proximal end and a distal end opposing said proximal end;

(b) a plurality of baffles carried by said housing, a baffle of said plurality of baffles having a central hole and a radial gap formed between a portion of said baffle and a portion of said housing;

(c) an inlet nozzle carried by and covering said proximal end of said housing, said inlet nozzle having a flared orifice, and wherein said inlet nozzle and said plurality of baffles defines a first expansion chamber therebetween; and (d) an end cap carried by said distal end of said housing, said end cap having a proximal surface and a distal surface, said end cap having an exit hole formed to have a plurality of grooves radiating from said proximal surface to said distal surface, and wherein said plurality of baffles and said end cap define a second expansion chamber therebetween, said second expansion chamber being smaller than said first expansion chamber, wherein a groove of said plurality of grooves of said exit hole in said end cap has a hemispherical depression formed in said distal surface of said end cap.

2. The suppressor as recited in claim 1, wherein said plurality of baffles includes a first baffle and a second baffle, said first baffle having a first radial gap and said second baffle having a second radial gap, wherein said first radial gap and said second radial gap are not aligned.

3. The suppressor as recited in claim 1, wherein said baffle has a proximal face and a distal face, and wherein said proximal face is perpendicular to said axis of the housing but the distal face is not perpendicular to said axis of the housing.

4. The suppressor as recited in claim 3, wherein said distal face of said baffle leans toward said proximal end.

5. The suppressor as recited in claim 3, wherein said proximal face has a first portion and a second portion, wherein said first portion and said second portion lie in different planes.

6. The suppressor as recited in claim 5, wherein said first portion defines part of said central hole and second portion defines part of said central hole.

7. The suppressor as recited in claim 5, wherein said first portion of said proximal face is formed to define a step in proximal face of said baffle at said central hole.

8. The suppressor as recited in claim 1, wherein said proximal surface of said end cap has a toroidal shape.

9. The suppressor as recited in claim 1, wherein said plurality of grooves is three grooves.

10. The suppressor as recited in claim 1, wherein said end cap at said proximal surface of said exit hole is beveled.

11. A suppressor for use with a firearm, said suppressor comprising:

(a) a housing having an axis, a proximal end and a distal end opposing said proximal end;

(b) a plurality of baffles in said housing, a baffle of said plurality of baffles having a central hole and a radial gap, said baffle having a proximal face and a distal face, said distal face not being perpendicular to said axis of said housing;

(c) an inlet nozzle carried by and covering said proximal end of said housing, said inlet nozzle having a flared orifice, said inlet nozzle and said plurality of baffles being spaced apart to define a first expansion chamber therebetween; and (d) an end cap carried by and covering said distal end of said housing, said end cap having a proximal surface and a distal surface opposing said proximal surface, said proximal surface having a toroidal shape, said distal surface having a central hole that includes a plurality of radial grooves, and wherein said plurality of baffles are spaced apart from said proximal surface of said end cap to define a second expansion chamber therebetween, said second expansion chamber being smaller than said first expansion chamber, wherein a groove of said plurality of radial grooves of said end cap begins at said inner surface of said exit hole of said end cap and forming a hemispherical depression formed at said outer surface.

12. The suppressor as recited in claim 11, wherein a portion of said proximal face of said baffle is at an angle with respect to said distal face.

13. The suppressor as recited in claim 12, wherein said portion of said proximal face forms a step at said central hole of said baffle.

14. The suppressor as recited in claim 11, wherein said baffle has a first part adjacent said central hole and a second part adjacent said central hole, said second part being beveled.

15. The suppressor as recited in claim 11, wherein plurality of radial grooves is three grooves.

16. The suppressor as recited in claim 11, wherein said inner surface of said exit hole of said end cap is beveled.

17. A suppressor for use with a firearm, said suppressor comprising:

(a) a housing having an axis, a proximal end and a distal end opposing said proximal end;

(b) a plurality of baffles in said housing, a baffle of said plurality of baffles having a central hole, a proximal face and a distal face, said baffle having a radial gap between said baffle and said housing;

(c) an inlet nozzle covering said proximal end of said housing, said inlet nozzle having a flared orifice, said inlet nozzle and said plurality of baffles being spaced apart to define a first expansion chamber;

(d) an end cap covering said distal end of said housing, said end cap having in inner surface and an outer surface, said outer surface being curved and said end cap having a central hole with a plurality of radial grooves formed therein and radiating from said central hole, said plurality of baffles being spaced apart from said inner surface of said end cap to define a second expansion chamber, said second expansion chamber being smaller than said first expansion chamber, wherein a groove of said plurality of radial grooves of said end cap has a hemispherical depression formed at said outer surface.

18. The suppressor of claim 17, wherein said proximal face has a first portion and a second portion, said first portion being perpendicular to said axis of said housing and said second portion being at an angle with respect to said axis of said housing, said first portion including part of said central hole and said second portion including a second part of said central hole, said second part of said central hole having a beveled edge.

* * * * *